US005787748A

United States Patent [19]

Knudson et al.

[11] Patent Number: 5,787,748

[45] Date of Patent: Aug. 4, 1998

[54] VARIABLE PANEL FORMING APPARATUS AND METHOD

[76] Inventors: Gary A. Knudson, 30401 Heavenly Ct., Evergreen, Colo. 80439; Patrick D. Flood, 276 Eagle Dr., Golden, Colo. 80403

[21] Appl. No.: 723,495

[22] Filed: Sep. 30, 1996

[51] Int. Cl.[6] ..... B21D 5/08

[52] U.S. Cl. ..... 72/181

[58] Field of Search ..... 72/181, 180, 176, 72/226

[56] References Cited

U.S. PATENT DOCUMENTS

| | | | |
|---|---|---|---|
| 3,756,057 | 9/1973 | Brooks | 72/181 |
| 3,791,185 | 2/1974 | Knudson | 72/181 |
| 3,823,592 | 7/1974 | Colbath | 72/181 |
| 4,411,146 | 10/1983 | Sulasaari | 72/181 |
| 4,716,754 | 1/1988 | Youngs | 72/181 |
| 4,811,587 | 3/1989 | Knudson | 72/181 |
| 4,899,566 | 2/1990 | Knudson | 72/181 |
| 5,038,592 | 8/1991 | Knudson | 72/181 |
| 5,148,694 | 9/1992 | Pearson et al. | 72/181 |

*Primary Examiner*—Daniel C. Crane

*Attorney, Agent, or Firm*—Ancel W. Lewis, Jr.

[57] ABSTRACT

Variable panel forming apparatus and method disclosed have spaced drive stations and spaced forming stations interspersed with one another and operable independently of one another. The drive stations have upper and lower rollers each independently adjustable to accommodate different panel widths. One embodiment has the forming stations and drive stations mounted on separate frame top cross members with a yoke and an indexing/locating arrangement and a lock down system which enables the stations to be laterally adjusted and to be removed to accommodate different panel widths and different panel shapes. A second embodiment disclosed has the forming and drive stations on the same frame top cross member and has adapter plates and mounting plates with lateral adjustability features to form different panel shapes and sizes.

23 Claims, 9 Drawing Sheets

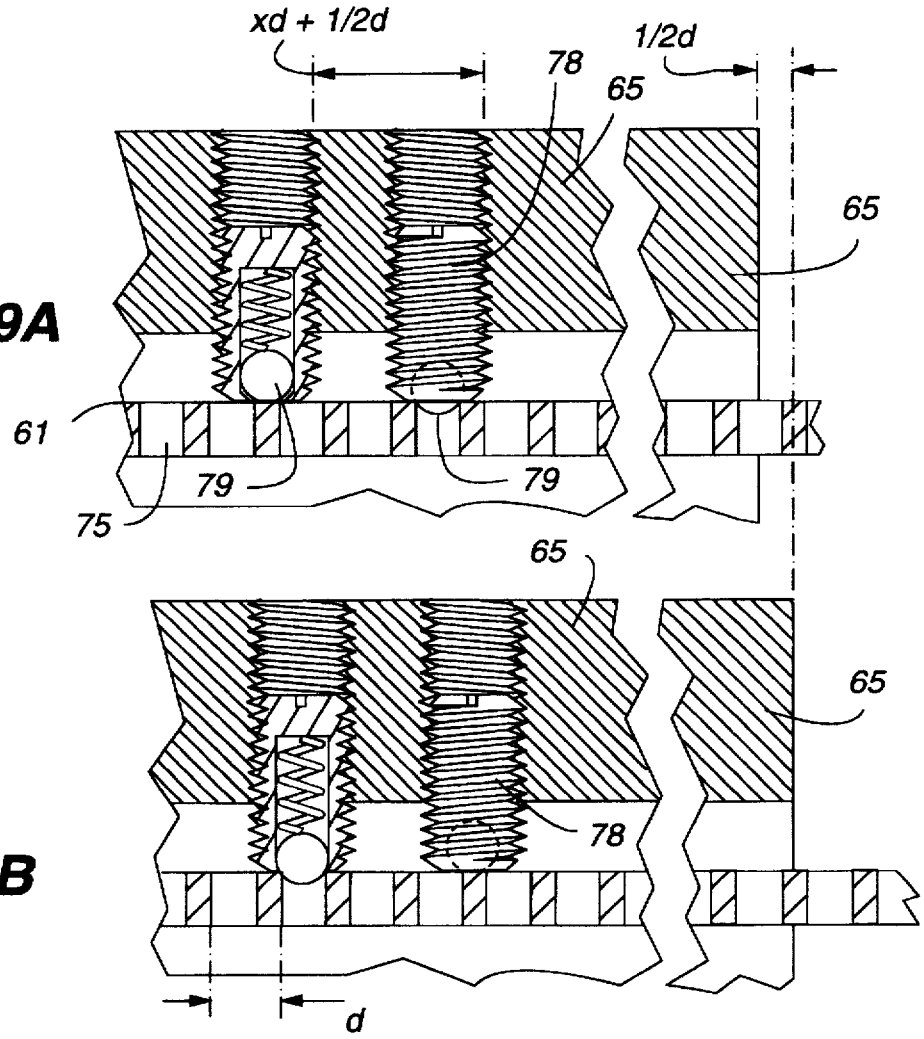
Fig. 9A
Fig. 9B
Fig. 10
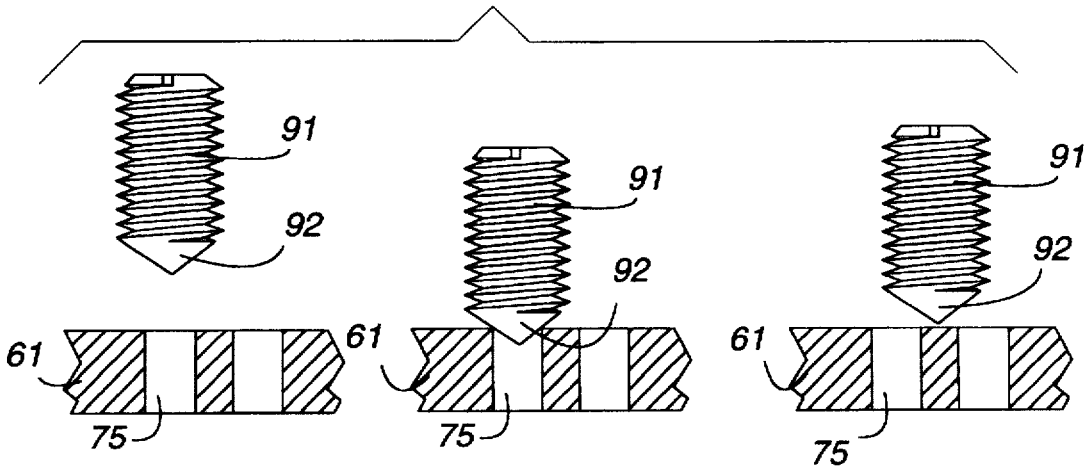

Fig. 11
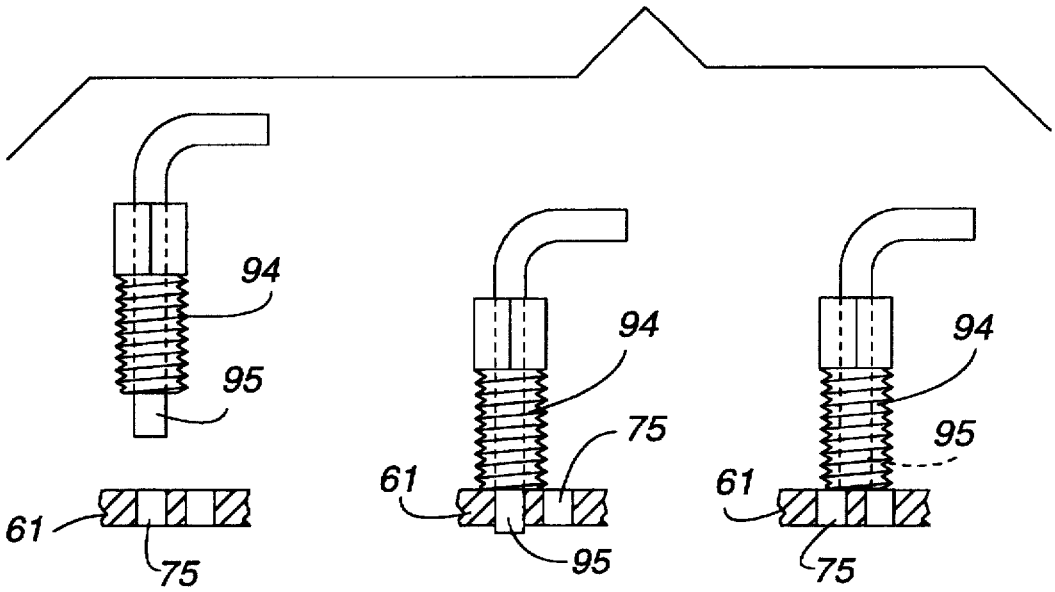
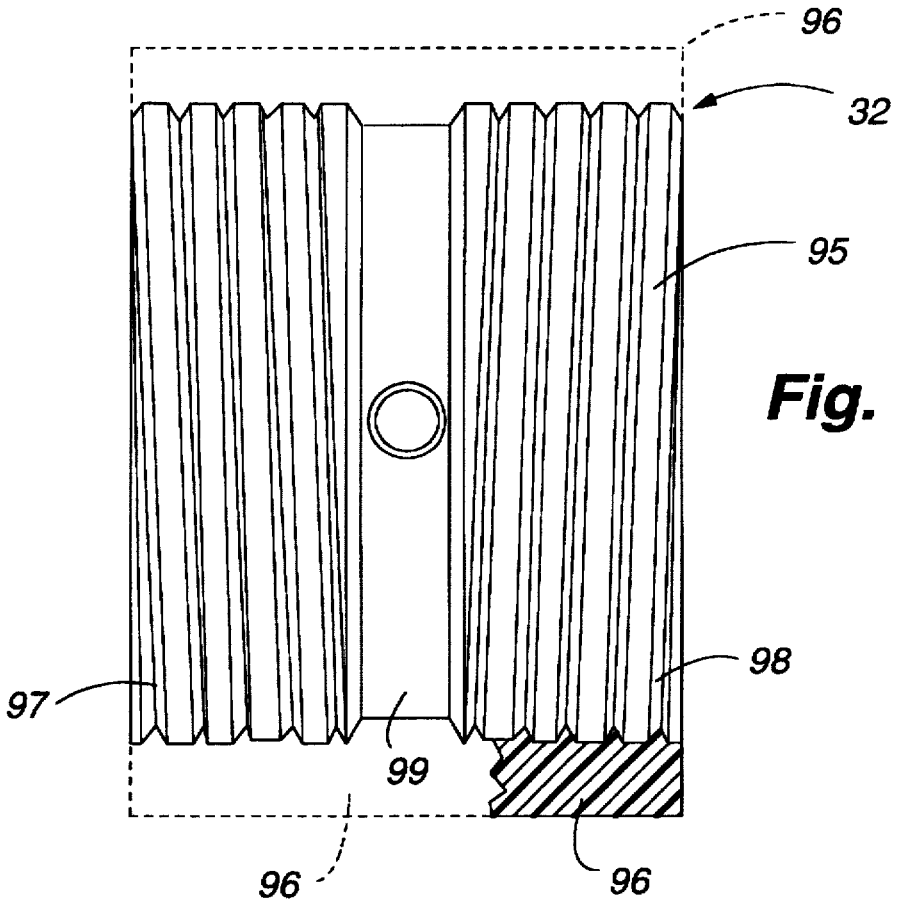
Fig. 12

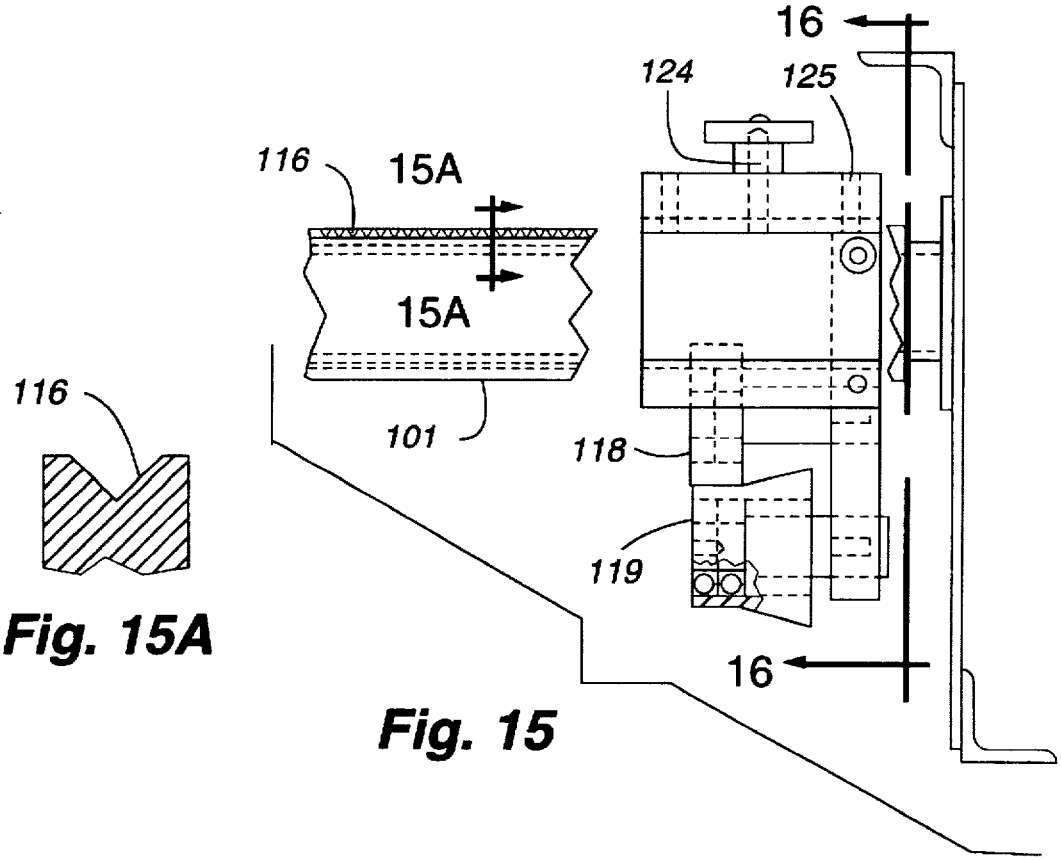
Fig. 15A
Fig. 15
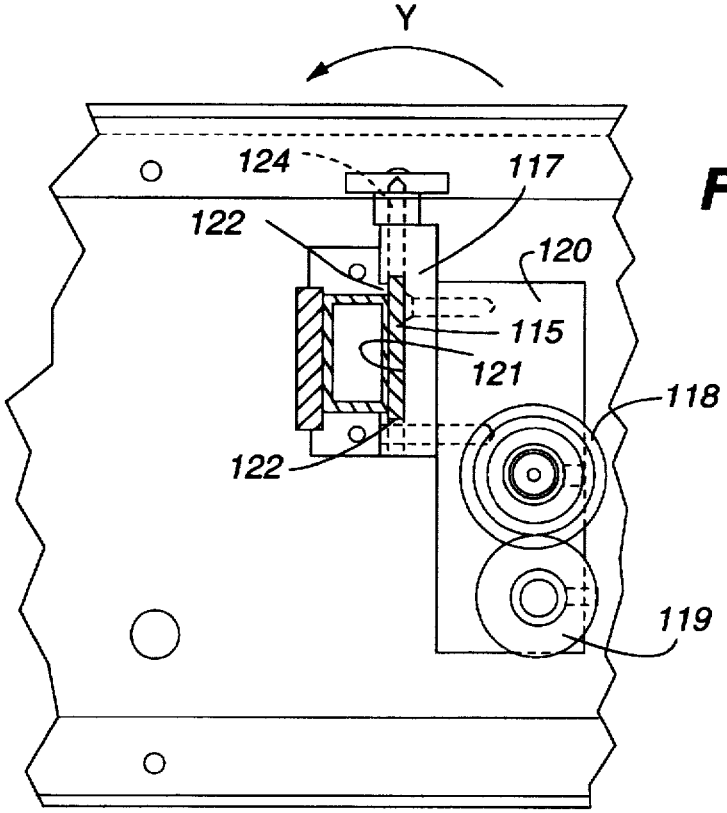
Fig. 16
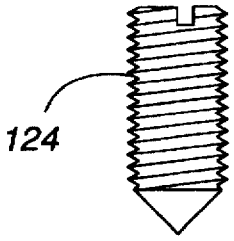
Fig. 16A

VARIABLE PANEL FORMING APPARATUS AND METHOD

TECHNICAL FIELD

This invention relates to roll-forming apparatus and methods and more particularly to a variable panel forming apparatus and method that will produce a wide range of panels or other sections of different shapes and sizes.

BACKGROUND ART

Some roll-forming apparatus has powered rollers which propel the stock material and forming rollers which form the panel profiles. There have been earlier attempts to use the same apparatus to provide panels of different shapes and/or different sizes.

Knudson U.S. Pat. No. 3,791,185 discloses apparatus for forming siding for buildings wherein the lower of each pair of a group of pairs of rollers are dropped down so that the same apparatus may be used to form different siding shapes.

Knudson U.S. Patent No. 4,899,566 discloses pairs of rollers in roll-forming apparatus having lateral adjustments of the rollers in each pair to form shaped panels having different panel widths from the same rollers.

Knudson U.S. Pat. No. 5,038,592 discloses roller sections that have selective axial adjustments to change the width of the formed member.

Pearson et al. U.S. Pat. No. 5,148,694 discloses sets of rollers on one side that move relative to axially aligned sets of roller on the other side to vary the width of a formed member.

DISCLOSURE OF THE INVENTION

A variable panel forming apparatus and method disclosed has a series of spaced drive stations and a series of spaced forming stations interspersed with the drive stations that are operable independently of one another. The drive stations have powered lower rollers and idled upper rollers each laterally adjustable independently of one another to accommodate different panel widths. Each drive roller has a metal hub with special grooves and a urethane coating to provide improved drive and non-marking characteristics.

In one embodiment the forming stations and drive stations have separate frame top cross members with the forming stations having yokes that support two sets of spaced forming rollers and are readily removed and replaced to accommodate forming different panel shapes. An indexing/locating system uses a retractable plunger and indexing holes in the cross members to vary the lateral position and a lock down system that holds each yoke at a precise position on the frame cross member.

A second embodiment has forming and drive stations supported on a single frame top cross member and utilizes an arrangement of adapter plates, mounting plates, set screws and detents for interchangeability and the forming stations counterbalance the top drive roller to provide a downward force on the top drive roller. The second arrangement is used more when more drive power is required.

BRIEF DESCRIPTION OF THE DRAWINGS

Details of this invention are described in connection with the accompanying drawings which like parts bear similar reference numerals in which:

FIG. 9A is an enlarged sectional view taken along lines 9A—9A of FIG. 6 showing the variable width adjustment of the roll forming station.

FIG. 9B is an enlarged elevation view similar to FIG. 9A with the yoke adjusted laterally.

FIG. 10 is a side elevation view similar to FIGS. 9A showing an alternative adjustment.

FIG. 11 is a side elevation view similar to FIGS. 9A showing another alternative adjustment.

FIG. 12 is a side elevation view of a drive station roller.

FIG. 15 is an end elevation view of a forming station of the second embodiment shown in FIGS. 13 and 14.

FIG. 15A is a fragmentary sectional view along lines 15A—15A of FIG. 15 showing the detent.

FIG. 16 is a sectional view taken along lines 16—16 of FIG. 15.

FIG. 16A is a detail of the set screw used in FIG. 16.

DETAILED DESCRIPTION

Figures 1, 2:
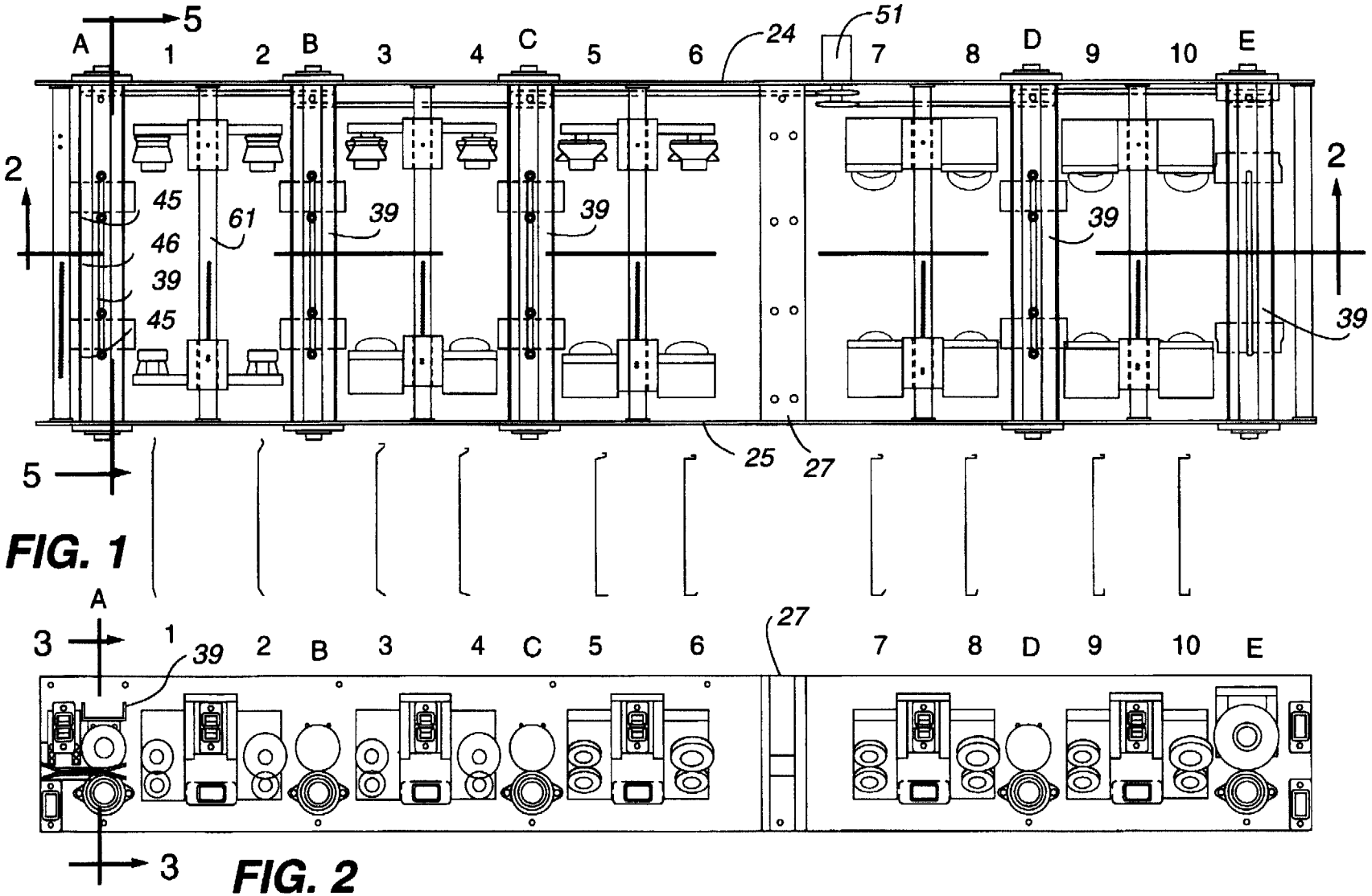
FIG. 1 is top plan view of a variable panel forming apparatus embodying features of the present invention with panel shapes shown along one side of the apparatus.
FIG. 2 is a sectional view taken along lines 2—2 of FIG. 1.
Figure 3:
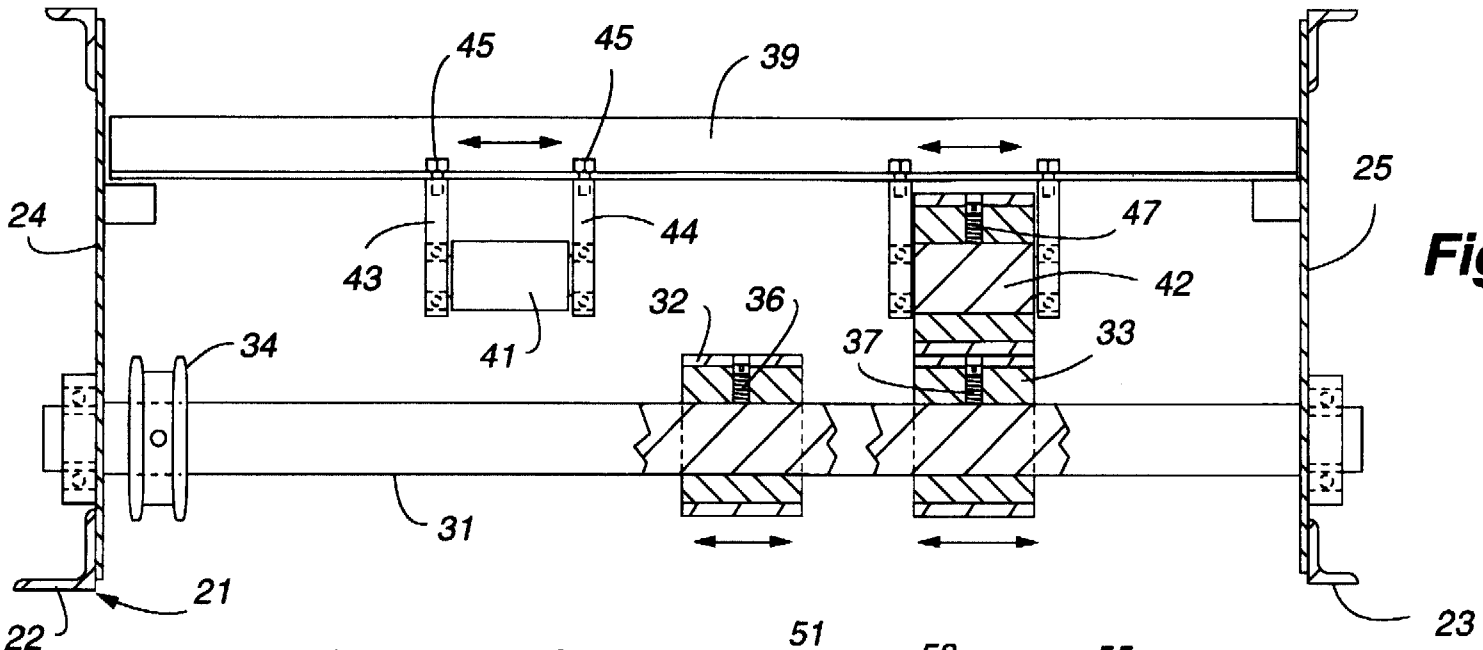
FIG. 3 is a sectional view taken along lines 3—3 of FIG. 2.

Referring now to FIGS. 1 through 3 there is shown a first embodiment of panel forming apparatus embodying features of the present invention which, generally stated, includes a support frame 21 having a pair of laterally spaced angle iron feet 22 and 23 to which are attached opposed side plates 24 and 25, respectively, five spaced drive stations designated by letters A–E and ten spaced roll forming stations designated by numerals 1–10 supported by the support frame 21. Proceeding from the inlet to the outlet of the apparatus the alternating drive and forming stations are A, 1, 2, B, 3, 4, C, 5, 6, 7, 8, D, 9, 10, E. A shear 27 is mounted between forming stations 6 and 7 to cut the shaped panels to a selected length.

Each drive station is of a similar construction and with reference to station A and FIG. 3 each has a lower shaft 31 mounted for rotation in bearings in the side plates 24 and 25. A left powered bottom drive roller 32 and a right powered bottom drive roller 33 are mounted on the shaft 31 and a drive sprocket 34 is mounted on the shaft 31. The bottom rollers are slidable on the shaft 31 for adjusting the bottom roller to a selected lateral position. A set screw 36 recessed in a hole in roller 32 and a set screw 37 recessed in a hole in roller 33 locks the respective rollers to shaft 31.

The support frame 21 has a drive top cross member 39 in the shape of a channel which extends between the side plates and supports a left top idler drive roller 41 and a right top idler drive roller 42. Referring to roller 41 each drive roller is supported by a pair of side plates 43 and 44. Mounting bolts 45 extend through an elongated slot 46 in cross member 39. The right side roller has a set screw 47. Each top roller is adjusted by sliding mounting bolts 45 from side to side in the slots 46 and then tightening the mounting bolts.

Figure 4:
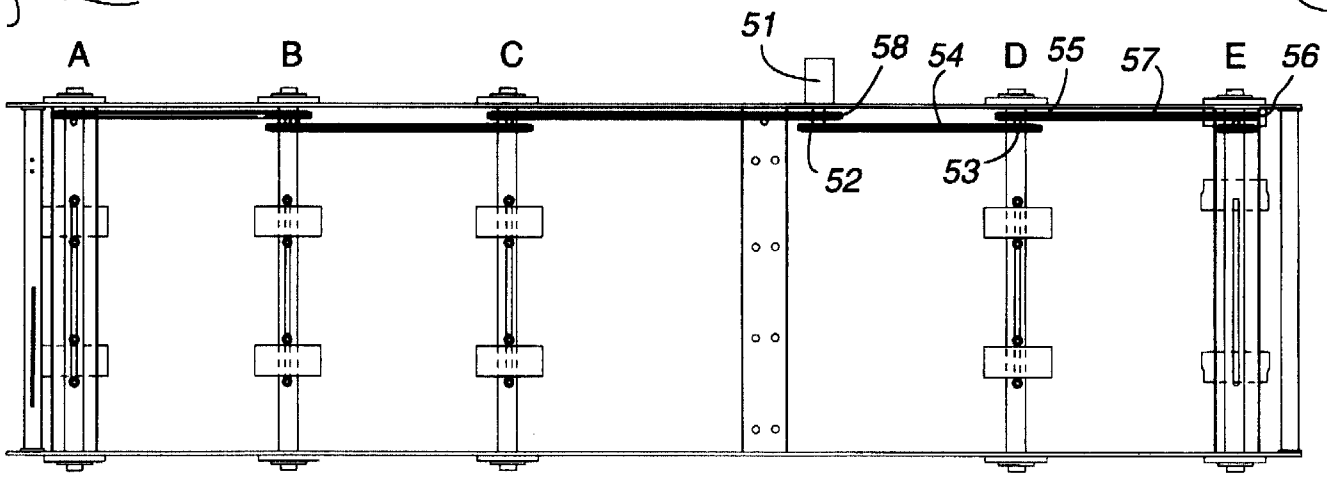
FIG. 4 is a top plan view showing only the drive train below the top rollers and the first and last drive top cross members at drive station A and E.

The power train for the drive stations shown in FIG. 4 is a motor 51 mounted on side plate 24 having a main drive sprocket 52 for driving sprocket 53 on the lower shaft of station D via a chain 54. The lower shaft of station D has a sprocket 55 connected to a sprocket 56 via a chain 57. Similarly, a second drive sprocket 58 on the motor shaft connects to sprockets on the lower shafts of stations C, B and A via connecting chains.

Figure 7:
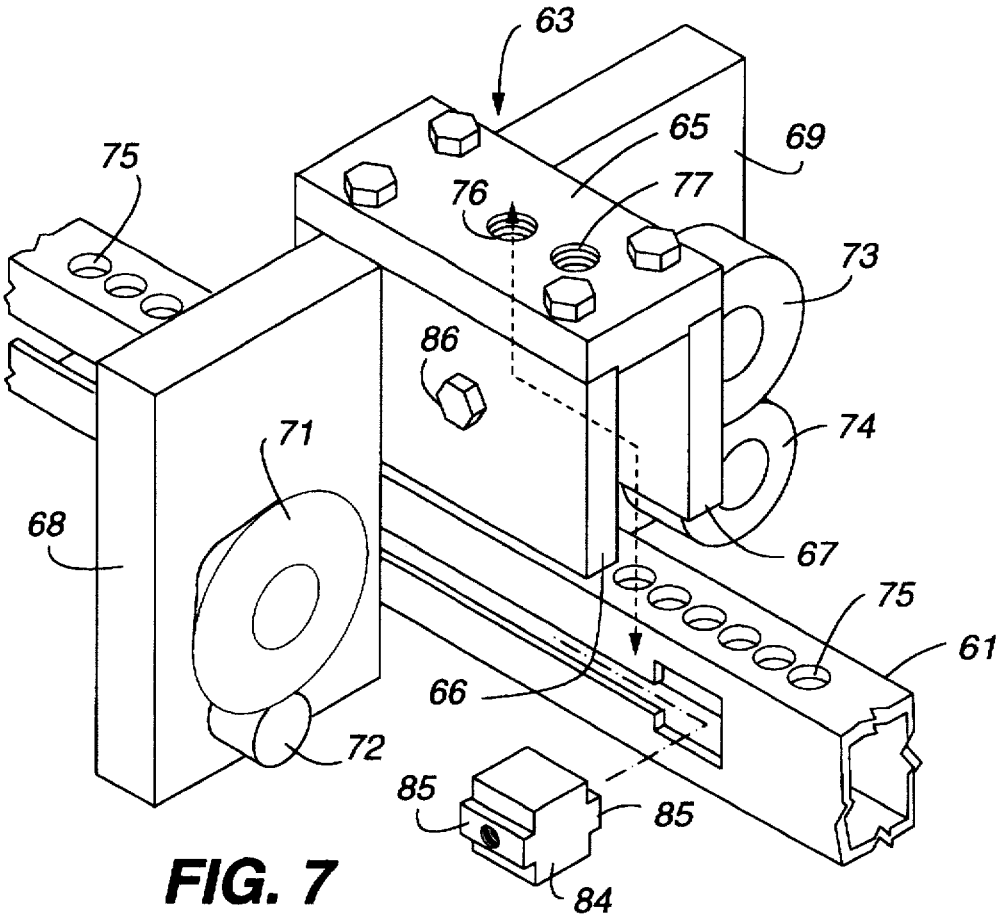
FIG. 7 is an exploded perspective view of the right side yoke, cross member and lock down key with the yoke shown in an elevated position.

The support frame 21 has a frame top cross member 61 in the form of a tube connected to and extending between the side plates 24 and 25. Each roll forming station has a left side yoke 62 and a right side yoke 63. Both yokes 62 and 63 straddle and are supported on cross member 61. Referring now to FIG. 7 the right side yoke 63 shown has a top plate 65, a pair of side plates 66 and 67, and a pair of end plates 68 and 69 extending out from side plates 66 and 67, respectively. Yoke 63 is supported to slide laterally on top of the top cross member 61.

End plate 68 supports a pair of upper and lower panel forming rollers 71 and 72 and end plate 69 supports a pair of upper and lower panel forming rollers 73 and 74. The shape of these panel forming rollers changes at each successive forming station to change the panel shapes as indicated by the succession of panels in FIG. 1.

As shown in FIGS. 1 and 2 the frame top cross member 61 of each forming station and the drive top cross members 39 of each drive station alternate in spaced increments and are shown as being on similar center distance spacing. The two sets of forming rollers 71, 72 and 73, 74 above described are mounted off each forming top frame cross member 61 one set on each side. Prior to mounting, the center distance between the forming rollers approximates the distance between the forming frame top cross member 61 and frame top cross member 39 at each drive station. Therefore, when the forming rollers are mounted straddling a frame top cross member 61 they become interlaced between the top frame cross members 61 and member 39 at a drive station on each side. In this manner critical center distance is maintained while no lateral or longitudinal interference exists between any components. Through this arrangement the drive train and forming rollers have complete and independent variability. It is noted that drive rollers are not fixed relative to the frame or one another. This provides flexibility in the number of drive rollers that may be utilized at each station. Additional sets of drive rollers may be introduced for additional drive power or for additional support across the breadth of wider panel configurations.

Figure 8:
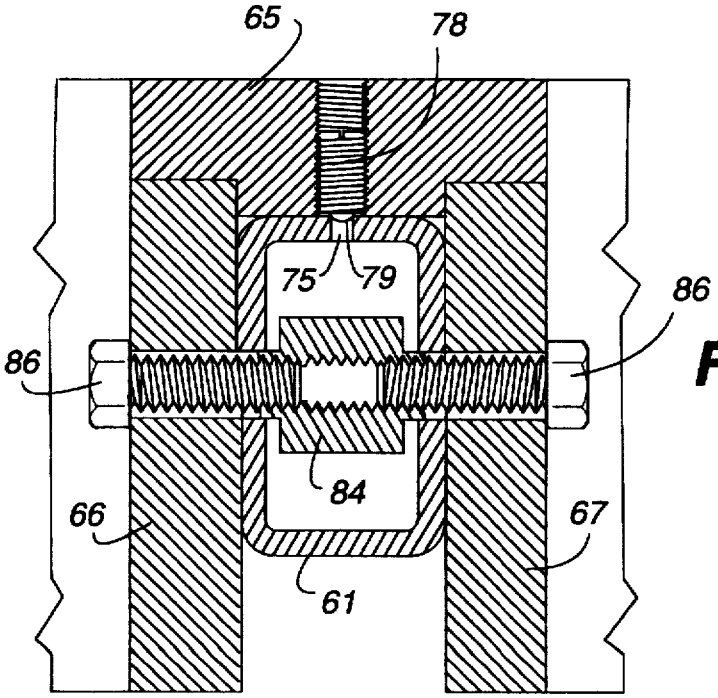
FIG. 8 is a sectional view taken along lines 8—8 of FIG. 5.

An indexing/locating system for each yoke is achieved through a ball plunger/indexing hole locating arrangement. In FIGS. 7 and 8 there is shown for yoke 63 that the top face of the frame top cross member 61 has a single row of spaced holes 75 in selected uniform distance increments. The top plate 65 has two threaded holes 76 and 77 into either of which a ball plunger set screw 78 can be threaded. The ball plunger set screw 78 is set into the top plate to a depth where the ball plunger 79 protrudes through a spring loaded extension beyond the bottom face of the top plate. When the yoke 63 straddles the cross member 61 the bottom face of the top plate and the top face of the cross member 61 rest flush against one another. The plunger 79 protrudes concentrically into one of the locating holes 75 thus locating the yoke 63.

This precise location for the forming stations is illustrated in FIGS. 9A and 9B. The relative diameter of the ball plunger 79 increases as the spherical ball extends beyond the bottom face of the top plate. The locating holes 75 are sized relative to the ball plunger 79 so that the ball plunger protrudes into a hole, the diameter of the ball plunger matches the diameter of the locating hole before the ball plunger is fully extended. Therefore, the spherical ball plunger self-locates precisely in the center of the locating hole with no misalignment. The weight of the yoke holds the top plate against the cross member holding the ball plunger in its precise center location preventing any further extension of the ball plunger.

The forming stations are thus indexed at fixed increments side to side to achieve a variable width in the panel. If the distance increment between the top frame cross member locating holes 75 equals "d" then the distance between the holes of the top plate equals an even multiple of distance "d" plus one half of the distance "d". Through this relative position of the locating holes and the location of the ball plunger set screw, width adjustment increments of one half distance "d" may be achieved. Additional holes may be added to the top plate and spaced incremently from the hole ¼ "d" ⅛ "d" to achieve smaller width dimension increments.

Because the entire yoke requires no disassembly-assembly the ball plunger locating hole system facilitates specific repetitive positioning relation to the support frame. By eliminating intermediate mounting surfaces and replacing disassembly—assembly processes with a precise locating system changeover of the forming rollers of the present invention avoids misalignment typical in other changeover systems. The ball plunger/locating hole system and yoke mounting lends itself to rapid tooling changeovers. With removal of two bolts described hereinafter a yoke may be easily lifted vertically off the top cross frame member and replaced with a different set of tooling or roll forming rollers. The ball plunger/locating hole system provides for a quick, direct, accurate means of locating the tooling as it is replaced. The system is simple to change and the locating system provides a rapid means for tooling alignment without reliance on removable fasteners for locating purposes. The variable width adjustment indexing increments are small enough to approach a near infinite series of adjustments. Changeover of adjustable forming rollers inherently requires disassembly and assembly. In the present invention the yokes are preassembled units. Near absolute positioning is readily achieved through this method.

Figure 6:
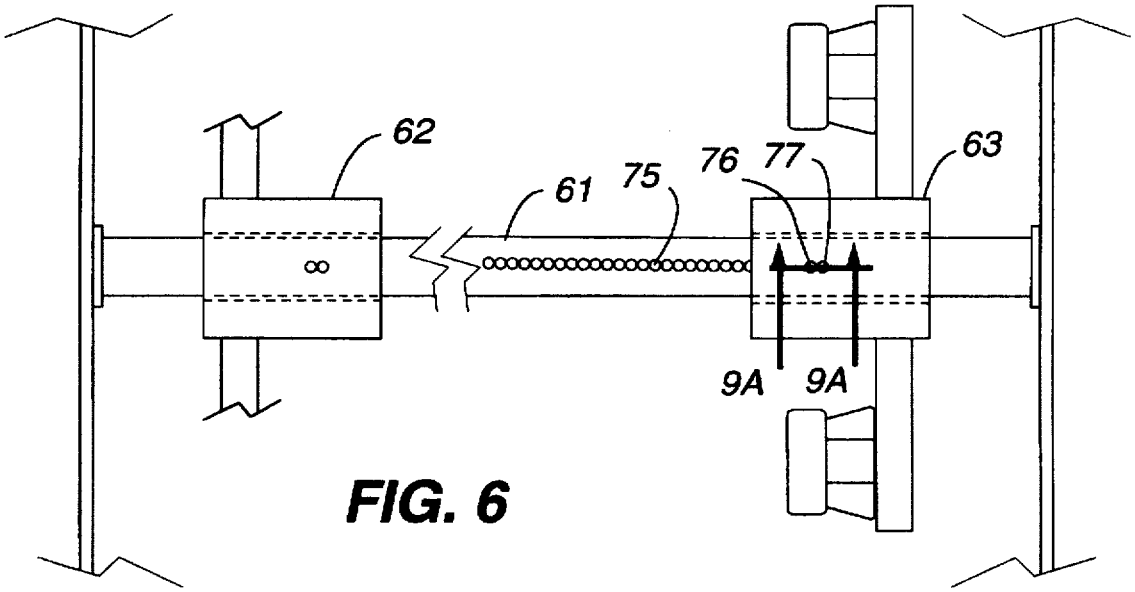
FIG. 6 is a top plan view of FIG. 5.

Referring now to FIG. 6, the left side yoke 62 is similar to the right side yoke 63 but member 61 has only two locating holes and the top plate of the yoke only one hole with one set screw to provide only two different positions for the yoke 62. This accommodates varying panel profile requirements on the fixed left side of the apparatus.

Figure 5:
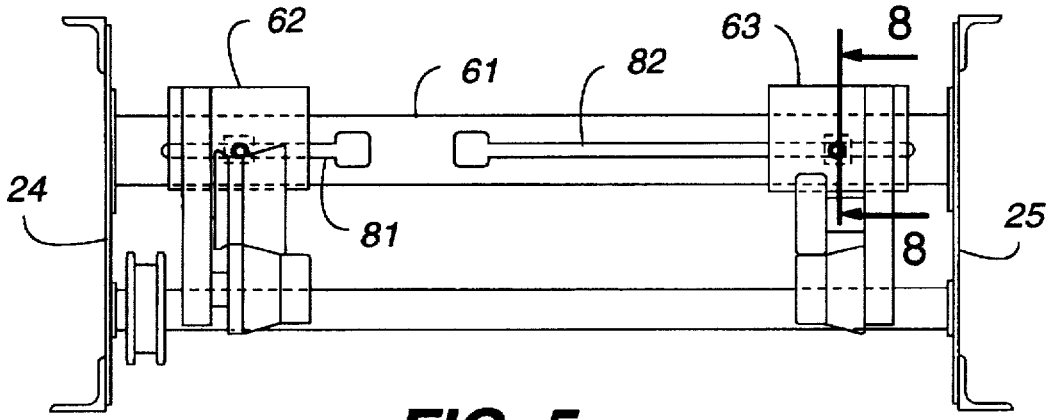
FIG. 5 is a sectional view taken along lines 5—5 of FIG. 1 showing the first forming station.

Referring now to FIGS. 5, 7 and 8, the lock down system for the yoke 63 will now be described. Yoke 62 has the same lock down system. The sides of the top frame cross member 61 have a left side pair of opposed linear slots 81 and a right side pair of opposed linear slots 82 which run parallel to the row of locating holes 75. A rectangular key 84 with rectangular protrusions 85 on opposite sides are fitted inside the frame top cross member 61. The rectangular protrusions 85 extend partially into the linear slots 82. Two lock down bolts 86 extend inward through the side plates of the yoke into each side of the lock down key. This key slot combination has a variety of functions. The primary function of the lock down keys 84 is to secure the yokes in place after they have been precisely located by the ball plunger/locating hole system. By tightening the lock down bolts 86 on each side of the yoke the yoke squeezes the frame cross tube member 61. The static friction pressure from squeezing adequately secures the yoke in place preventing any movement during forming operations or transport.

The rectangular protrusions 85 which extend into the linear slot also prevent vertical motion of the yoke. This helps the ball plunger maintain an accurate seat in the locating holes.

When the lock down bolts 86 are loosened, the linear slot allows the tooling to be repositioned side to side for changes in profile width by sliding the yoke side to side. When the lock down bolts are loose enough, side pressure applied to the yoke will cause the top frame cross member to force the ball plunger to retract allowing the tooling yoke to be moved side to side. During sideways motion the ball plunger will spring in and out as it passes over the locating holes. The lock down bolts 86 must be removed prior to the lifting of the tooling yoke vertically off the top frame cross member and replaced when a different tooling yoke has been installed. The lock down key maintains its position inside the cross member unless repositioned by the operator. It is understood that alternate adjustment arrangements for the lateral adjustment of the yokes may be used.

Referring now to FIG. 10 there is shown an externally threaded set screw 91 with a tapered point 92. In one position shown the set screw point 92 is above the hole 75, in a second position the tapered point is seated in the hole 75 and in a third position the tapered point is in a retracted position resting on the top surface of member 61 between the holes.

Another alternative adjustment shown in FIG. 11 uses a hollow externally threaded fitting 94 with a straight cylindrical plunger 95 extending therethrough. In one position the plunger and fitting are above the hole, in a second position the plunger is extended into the hole and in a third position the fitting and plunger are in a retracted position resting on the top surface of member 61 between the holes 75. This is the retracted position during adjustment.

Referring now to FIG. 12 there is shown one of the lower drive rollers 32 having a metallic hub 95 with a high durometer material 96 coated thereon. Material 96 may be generally characterized as having a high tensile strength, abrasion resistant polymer material. A polyester urethane having a durometer of 86A has been found as particularly suitable for this purpose because it provides improved drive and non-marking characteristics. A system of threads on the hub includes a series of right hand threads 97 which extend from the center of the hub outward to the left and a series of left hand threads 98 which extend from the center of the drive hub outward toward the right and a center line groove 99 around the hub perimeter. This thread system provides several advantages. The threads and groove significantly increase the surface onto which the urethane coating 96 can adhere. In addition the opposing right and left hand threads prevent any lateral slippage of the urethane while distributing the force of any perimeter flexure to both sides of the urethane. Therefore the perimeter force which typically causes delamination is distributed throughout the urethane in multiple directions rather than being allowed to focus in a single direction where delamination could occur more rapidly.

Referring now to FIGS. 13–17 there is shown a second embodiment of variable panel forming apparatus embodying features of the present invention. This embodiment generally stated uses a single frame top cross member 101 extending between the support frame side plates to support both the top drive roller and both top and bottom forming rollers as described hereinafter. In general, this apparatus has a series of top and bottom drive rollers on the left side and the right side and a series of top and bottom forming rollers on the left and right sides similar to the arrangement of the first embodiment above described. Generally stated, adapter plates 105 and 115 are mounted to each side of the frame cross bar member 101 onto which each top drive roller is mounted on the entry side and the top and bottom forming rollers are mounted on the exit side. In this manner successive frame top cross members 101 are spaced so as to maintain center distance between forming stations while preventing interference between drive and forming rollers.

Figure 13:
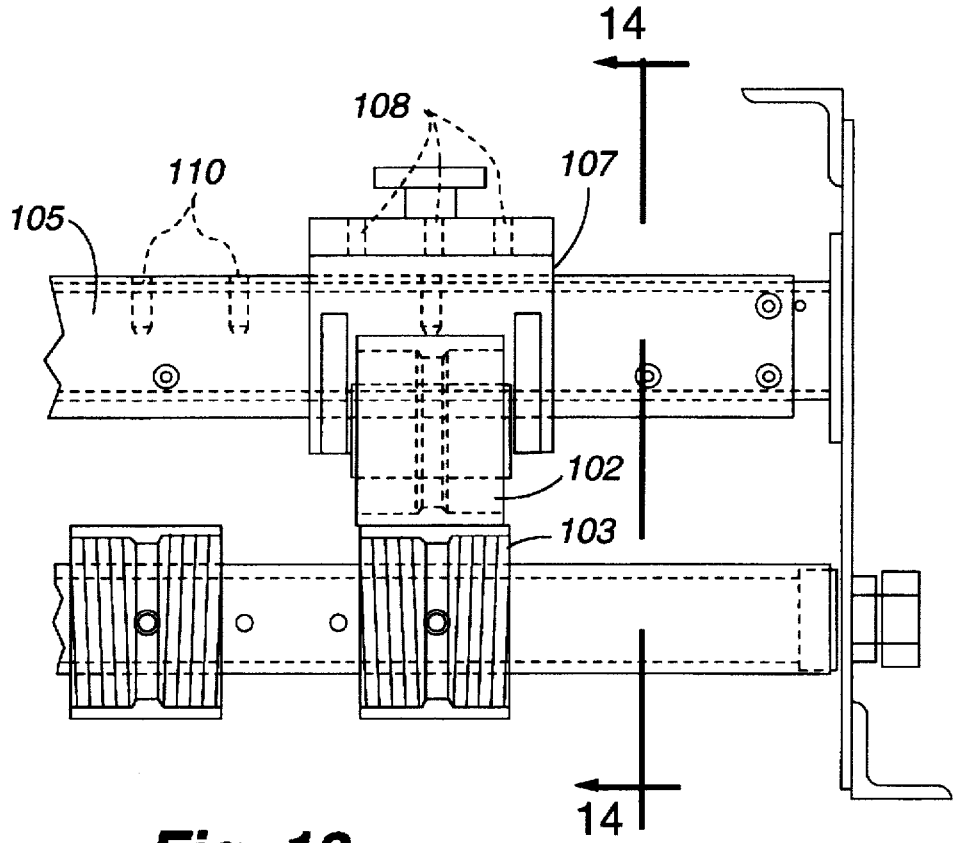
FIG. 13 is an end elevation view of an alternative of a drive station of a second embodiment of the present invention.
Figure 14:
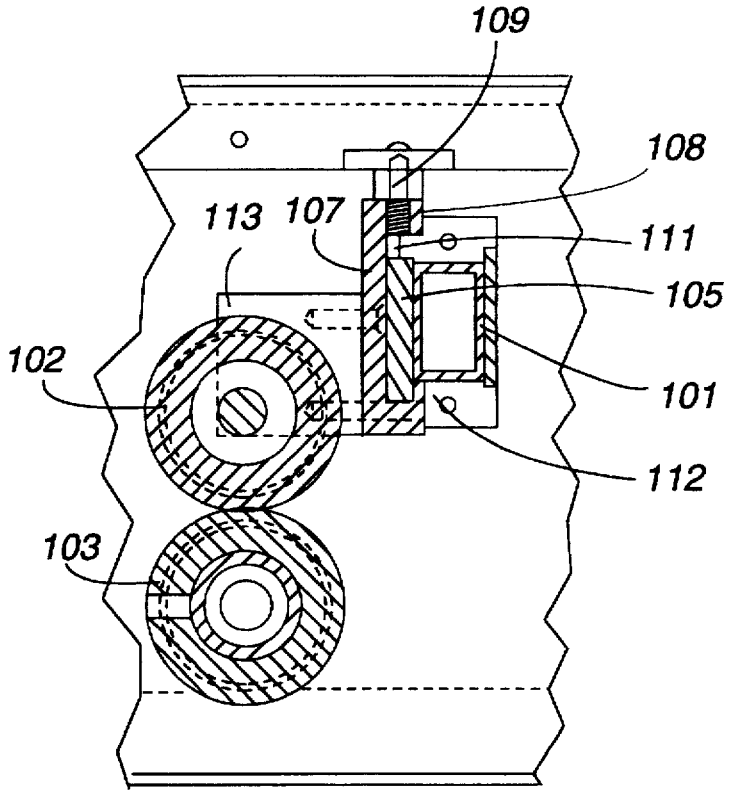
FIG. 14 is a sectional view taken along lines 14—14 of FIG. 13.

Referring now to FIGS. 13 and 14 the mounting for a top drive roller 102 and a bottom drive roller 103 will now be described. The top drive roller 102 utilizes a mounting system which allows a range of incremental positioning as well as the ability to adjust the downward drive pressures exerted on the bottom drive roller 103. The bottom drive roller 103 is mounted on a shaft independent of the top drive roller 102. The top drive roller 102 is an idled drive roller and the bottom roller 103 is a powered drive roller. An adapter plate 105 is attached to the entry side of the cross frame cross member 101. The drive adapter plate 105 has a series of threaded holes 110 on the top face which are used for attaching/locating the drive roller mounting plate 107. The drive roller mounting plate 107 onto which the top drive roller 102 is connected via a plate 113 has a series of spaced holes 108 in the top face through which a screw 109 is used to fasten the mounting plate 107 to the adapter plate 105. The mounting plate 107 contains a recessed area 111 with a notch 112 on the bottom side. The recessed area 111 fits over the adapter plate, the bottom notch 112 engages the bottom of the adapter plate 105 and a screw 109 through the mounting plate hole 108 into the adapter plate threaded hole 110 fastens the entire assembly. Due to planned interference with the bottom drive roller 103 and the top drive roller assembly, the top drive roller assembly is positioned vertically so the roller mounting plate's bottom notch remains engaged on the adapter plate and the screw 109 that is used to fasten the entire assembly may be adjusted to vary the downward drive pressure on the top drive roller 102 by holding the assembly in place.

Referring now to FIGS. 15 and 16 there is shown the mounting for the forming station. The forming roller adapter plate 115 has a series of spaced detents 116 in the top face which are incrementally spaced in the same manner as the frame cross member holes previously described in connection with the first embodiment. A forming roller mounting plate 117 into which the upper and lower forming rollers 118 and 119 are connected via a connecting plate 120 have a recessed area 121 and a top and bottom notch 122 which fit onto the adapter plate. The mounting plate 117 contains a series of spaced threaded holes 125 in its top face with the adapter plate 115 nested into the mounting plate. The end of the set screws 124 when threaded through holes 125 locate themselves into the detents 116 in a manner similar to that noted above in connection with the first embodiment. in driving the set screws 124 into the detents on the adapter plate top face the forming roller mounting plate 117 is lifted upward engaging the recessed bottom notch 122 in the adapter plate. In this embodiment the bottom of the adapter plate 115 becomes the critical mounting surface. The forming roller adapter plate 115, therefore, assumes the role of the frame top cross member by providing the detents used for lateral positioning as well as providing a critical mounting surface.

Figure 17:
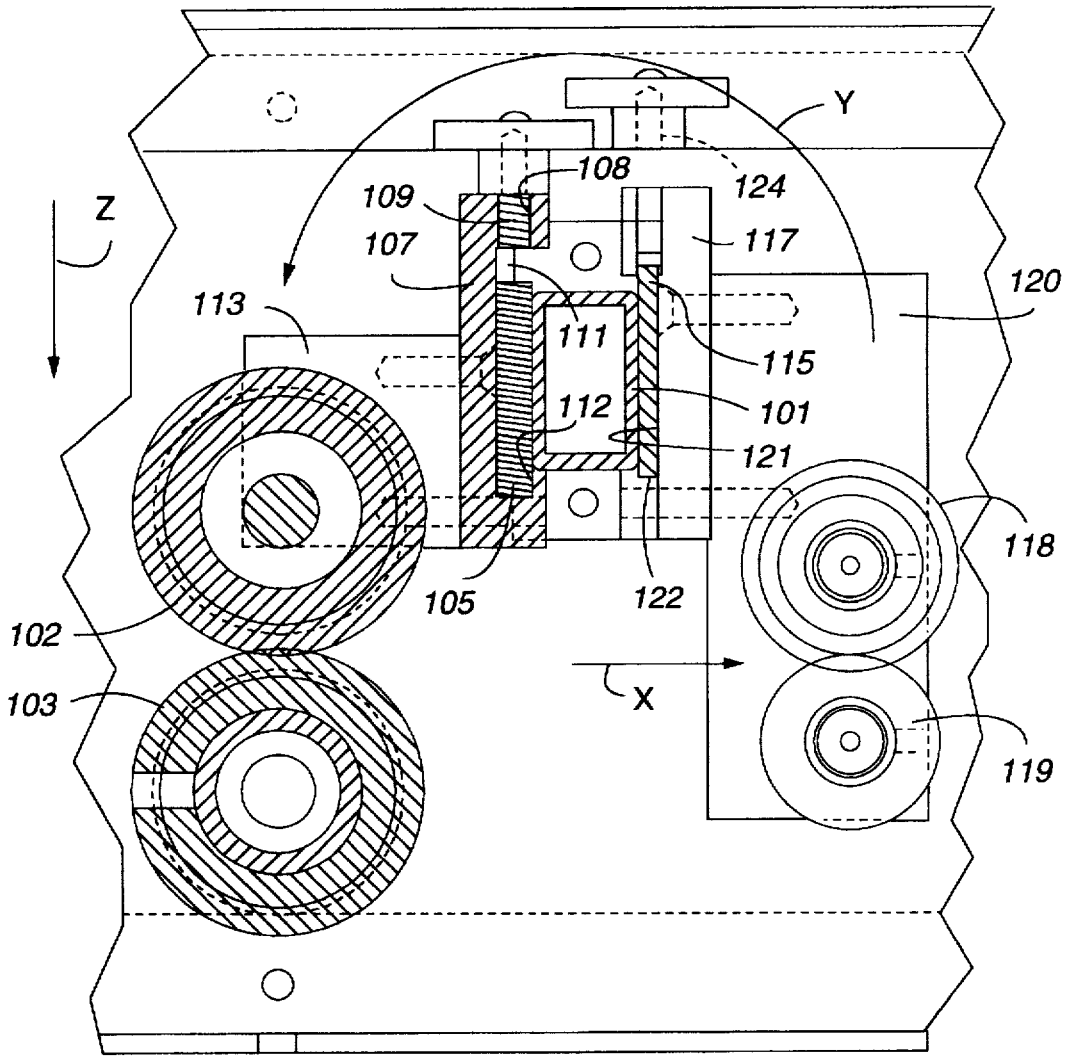
FIG. 17 is a sectional view similar to FIG. 14 showing both the drive and forming stations of the second embodiment.

In this embodiment, therefore, one drive station and one forming station are associated with a single frame top cross member. Rather than saddling the frame top cross member with tooling the forming station counterbalances the top drive roller about the frame top cross member. As shown in FIG. 17, when the drive rollers 102 and 103 push coiled sheet stock material through the forming rollers 118 and 119 a resistive force or drag indicated by arrow X is imparted to the forming rollers. Force X creates a torquing moment Y about the frame top cross member. Torquing moment Y generates a downward force Z on the top drive roller 102. This counterbalancing torque helps the machine balance the drag of forming operations against the drive pressure required to push the material through the machine. High forming drag requires higher drive pressure. This embodiment may be used when more drive power is required. The counterbalancing torque helps the machine self-adjust station by station for varying forming conditions.

In the second embodiment, then, the forming roller mounting plate recessed notches are positioned in such a way as to allow the forming roller mounting plate to be easily removed from the adapter plate for roll forming changeover as well as slide along the adapter plate for lateral adjustments. When the mounting bar set screws are removed the mounting bar top notch rests on the top face of the adapter plate. The notches are positioned and sized relative to the size of the adapter plate in such a manner as to allow the mounting bar bottom notch to swing clear of the adapter plate when the mounting plate is canted. When canted the bottom notch is clear of the adapter plate and the mounting plate may be lifted vertically off the top face of the adapter plate and removed from the apparatus. The reverse process is used to replace the mounting plate and adapter plate.

Although the present invention has been described with a certain degree of particularity, it is understood that the present disclosure has been made by way of example and that changes in details of structure may be made without departing from the spirit thereof.

What is claimed is:

1. Apparatus for making panels and other sections from a sheet material in a range of different panel shapes and sizes comprising:

a support frame having a first side plate and a second side plate, drive roller means on said support frame including a series of spaced drive stations to move a sheet material being shaped from an entry end to an exit end, each said drive station having powered drive rollers and idled drive rollers opposite said powered drive rollers, each of said powered and idled drive rollers at each drive station being independently laterally adjustable relative to said support frame to accommodate a range of panel widths, and forming roller means on said support frame operable independent of said drive roller means, said forming roller means including a series of spaced forming stations having forming rollers to progressively roll said material into a desired shape, each said forming station being spaced away from and interspersed between said drive stations along said support frame between said entry end and said exit end, each said forming station being independently laterally adjustable relative to said support frame, and removable from said support frame for replacement by another forming station for forming a selected different panel shape.

2. Apparatus as set forth in claim 1 wherein each of said idled drive rollers is mounted to a first frame top cross member that extends across said support frame from said first side plate to said second side plate and each of said forming stations is mounted to a second frame top cross member that extends across said support frame from said first side wall to said second side wall spaced from said first frame top cross member.

3. Apparatus as set forth in claim 1 wherein said drive stations and said forming stations are disposed at approximately equally spaced distance intervals.

4. Apparatus as set forth in claim 1 wherein there are two laterally spaced powered bottom drive rollers and two laterally spaced idled top drive rollers.

5. Apparatus as set forth in claim 1 wherein each of said drive rollers include a metallic hub and a high durometer urethane coating on the periphery of said hub.

6. Apparatus as set forth in claim 4 wherein said idled top drive rollers are mounted to a frame top cross member that extends across said support frame from said first side wall to said second side wall and said forming stations are mounted to the same frame top cross member.

7. Apparatus for making panels and other sections from a sheet material in a range of different panel shapes and sizes comprising:

a support frame, drive roller means on said support frame including a series of spaced drive stations to move a sheet material being shaped, each said drive station having two laterally spaced powered bottom drive rollers and two laterally spaced idled top drive rollers opposite said powered drive rollers, each of said powered and idled drive rollers at each drive station being independently laterally adjustable relative to said support frame to accommodate a range of panel widths, and forming roller means on said support frame operable independent of said drive roller means, said forming roller means including a series of spaced forming stations having forming rollers to progressively roll said material into a desired shape, each said forming station being removable from said support frame for replacement by another forming station for forming a selected different panel shape, said two idled top drive rollers being laterally adjustably mounted on said support frame by a frame top cross member with an elongated slot, a pair of depending side plates supporting each of said top drive rollers and a mounting bolt extending through and slidable in said slot and threaded to each of said plates to selectively tighten said top drive rollers to said frame top cross member.

8. Apparatus as set forth in claim 7 wherein said two powered bottom drive rollers are laterally adjustably mounted on said support frame by being slidable on a lower shaft, there being a set screw extending through each bottom roller and bearing against said shaft, said set screw being released to allow said bottom drive roller to move to a selected lateral position and to be held to said shaft when said set screw is tightened.

9. Apparatus for making panels and other sections from a sheet material in a range of different panel shapes and sizes comprising:

a support frame, drive roller means on said support frame including a series of spaced drive stations to move a sheet material being shaped, each said drive station having powered drive rollers and idled drive rollers opposite said powered drive rollers, each of said powered and idled drive rollers at each drive station being independently laterally adjustable relative to said support frame to accommodate a range of panel widths, and forming roller means on said support frame interspersed with and operable independent of said drive roller means, said forming roller means including a series of spaced forming stations having forming rollers to progressively roll said material into a desired shape, each said forming station being removable from said support frame for replacement by another forming station for forming a selected different panel shape, each of said drive rollers including a metallic hub and a high durometer urethane coating on the periphery of said hub, said hub having a series of right hand threads in the periphery extending from the center of said hub toward one end and a series of left hand threads in the periphery extending from the center toward an opposite end with a center line groove around the periphery of said hub between said left and right hand threads.

10. Apparatus for making panels and other sections from a sheet material in a range of different panel shapes and sizes comprising:

a support frame, drive roller means on said support frame including a series of spaced drive stations to move a sheet material being shaped, each said drive station having powered drive rollers and idled drive rollers opposite said powered drive rollers, each of said powered and idled drive rollers at each drive station being independently laterally adjustable relative to said support frame to accommodate a range of panel widths, and forming roller means on said support frame interspersed with and operable independent of said drive roller means, said forming roller means including a series of spaced forming stations having forming rollers to progressively roll said material into a desired shape, each said forming station being removable from said support frame for replacement by another forming station for forming a selected different panel shape, each of said forming rollers being removably and laterally adjustably mounted to said support frame by a frame top cross tube, a yoke on said cross tube, said yoke including a top plate and a pair of depending spaced side plates, said frame cross tube having a series of spaced indexing holes at selected uniform spaced increments along said tube and said top plate having a retractable member that extends into a selected of said holes to locate said yoke at selected positions along said cross tube.

11. Apparatus as set forth in claim 9 wherein there is a selected distance between said indexing holes, the distance between the holes in said top plates being equal to an even multiple of said selected distance plus one-half said selected distance.

12. Apparatus as set forth in claim 9 wherein said retractable member is a spring biased ball plunger.

13. Apparatus as set forth in claim 9 wherein said retractable member has a tapered point.

14. Apparatus as set forth in claim 9 wherein said retractable member has a cylindrical shaped plunger.

15. Apparatus as set forth in claim 9 including lock down means to releasably lock said yoke to said cross tube.

16. Apparatus as set forth in claim 9 wherein said lock down means includes a key with protrusions along each end that are slidable in a slot in said cross tube and a bolt extending through each side plate inserting into said key to tighten said yoke to said tube.

17. Apparatus for making panels and other sections from a sheet material in a range of different panel shapes and sizes comprising:

a support frame, drive roller means on said support frame including a series of spaced drive stations to move a sheet material being shaped, each said drive station having powered drive rollers and idled drive rollers opposite said powered drive rollers, each of said powered and idled drive rollers at each drive station being independently laterally adjustable relative to said support frame to accommodate a range of panel widths, and forming roller means on said support frame interspersed with and operable independent of said drive roller means, said forming roller means including a series of spaced forming stations having forming rollers to progressively roll said material into a desired shape, each said forming station being removable from said support frame for replacement by another forming station for forming a selected different panel shape, said idled top drive rollers being mounted to a frame top cross member that extends across said support frame from said first side plate to said second side plate and said forming stations being mounted to the same frame top cross member, said idled top drive rollers being at the side of said cross member nearer said entry end and said forming station being mounted opposite said idled top drive roller at the side of said cross member nearer said exit end.

18. Apparatus as set forth in claim 17 wherein said mounting for said idled top drive roller includes an adapter plate attached to said cross member and a mounting plate attached to said idled top drive roller, adjustment means including a throughhole in said mounting plate with a fastener and a series of threaded holes at spaced intervals along said cross member to selectively laterally adjust said mounting plate relative to said adapter plate to vary the width of said panel.

19. Apparatus as set forth in claim 17 wherein said mounting for said forming station includes an adapter plate attached to said cross member and a mounting plate attached to said forming rollers and adjustment means including a hole in said mounting plate with a set screw and a series of detents at selected intervals along said cross member to selectively laterally adjust said mounting plate relative to said adapter to vary the width of said panel.

20. Apparatus as set forth in claim 17 wherein said mounting plate is generally channel shaped by having a recessed area and a bottom notch with said adapter plate being disposed in said recessed area and seated on said bottom notch.

21. Apparatus as set forth in claim 18 wherein said mounting plate is generally channel shaped having a recessed area and a bottom notch with said adapter plate being disclosed in said recessed area and seated on said bottom notch, said mounting plate being removable from said adapter plate to permit changing said forming rollers.

22. Apparatus for making panels and other sections from a sheet material in a range of different panel shapes and sizes comprising:

a support frame having a first side plate and a second side plate, drive roller means including a series of spaced drive stations to move a sheet material being shaped, each said drive station having powered bottom drive rollers and idled top rollers opposite said powered drive rollers, each of said powered and idled drive rollers at each drive station being independently laterally adjustable to accommodate a range of panel widths, said idled top rollers being mounted on a first top frame cross member that extends between said first side wall and said second side wall, and forming roller means on a second top frame cross member that extends between said first side wall and said second side wall, said forming roller means interspersed with and operable independent of said drive roller means, said forming roller means including a series of spaced forming stations having forming rollers to progressively roll said material into a desired shape, said forming roller means being removable from said support frame for replacement by another forming roller means for forming a selected different panel shape.

23. Apparatus for making panels and other sections from a sheet material in a range of different panel shapes and sizes comprising:

a support frame having a first side plate and a second side plate, drive roller means including a series of spaced drive stations to move a sheet material being shaped, each said drive station having idled top drive rollers mounted on a top frame cross member that extends between said first side plate and said second side plate and powered bottom drive rollers opposite and mounted independently of said idled top drive rollers, each of said powered and idled drive rollers at each drive station being independently laterally adjustable to accommodate a range of panel widths, and forming roller means on said top frame cross member interspersed with and operable independent of said drive roller means, said forming roller means including a series of spaced forming stations having forming rollers to progressively roll said material into a desired shape, said forming roller means being removable from said top frame cross member for replacement by another forming roller means for forming a selected different panel shape, said drive rollers pushing material through said forming rollers to impart a resistive force to said forming rollers that provides a torquing counterbalancing moment about said cross member which generates a downward force on said top drive roller to balance the drag on the forming operation.

* * * * *